US011167189B2

(12) United States Patent
McGarvin

(10) Patent No.: US 11,167,189 B2
(45) Date of Patent: Nov. 9, 2021

(54) GOLF CLUB CLEANING AID

(71) Applicant: Rob McGarvin, Eagle, ID (US)

(72) Inventor: Rob McGarvin, Eagle, ID (US)

( * ) Notice: Subject to any disclaimer, the term of this patent is extended or adjusted under 35 U.S.C. 154(b) by 0 days.

(21) Appl. No.: 16/439,327

(22) Filed: Jun. 12, 2019

(65) Prior Publication Data

US 2019/0374827 A1 Dec. 12, 2019

Related U.S. Application Data

(60) Provisional application No. 62/684,048, filed on Jun. 12, 2018.

(51) Int. Cl.
*A63B 57/60* (2015.01)
*A46B 15/00* (2006.01)

(52) U.S. Cl.
CPC ..... *A63B 57/60* (2015.10); *A46B 2200/3073* (2013.01)

(58) Field of Classification Search
CPC ..... A63B 57/0087; A63B 57/60
See application file for complete search history.

(56) References Cited

U.S. PATENT DOCUMENTS

| | | | | |
|---|---|---|---|---|
| 2,682,072 | A | 6/1954 | Green | |
| 2,696,014 | A | 12/1954 | Richterkessing | |
| 2,744,276 | A | 8/1956 | Chambless | |
| 2,857,608 | A | 10/1958 | Schwartz | |
| 4,872,232 | A | 10/1989 | Stiasny | |
| 4,897,892 | A | 2/1990 | Bubien | |
| 4,907,540 | A * | 3/1990 | Reynolds | A01K 13/002 119/621 |
| D350,232 | S * | 9/1994 | Stangarone | D32/42 |
| 5,666,684 | A | 9/1997 | Cussen | |
| 5,930,920 | A | 8/1999 | Arnold | |
| 6,393,648 | B1 | 5/2002 | Reynolds | |
| 6,733,016 | B2 | 5/2004 | Chung | |
| 8,458,847 | B2 | 6/2013 | Herrmann | |
| 8,819,883 | B2 | 9/2014 | Laing | |
| 2012/0227198 | A1 * | 9/2012 | Blaszczec | A46B 5/0012 15/160 |
| 2013/0036562 | A1 | 2/2013 | Smith | |

FOREIGN PATENT DOCUMENTS

| | | | |
|---|---|---|---|
| EP | 0363572 | A2 | 4/1990 |

* cited by examiner

*Primary Examiner* — Michael D Jennings
(74) *Attorney, Agent, or Firm* — Scott D. Swanson; Shaver & Swanson, LLP

(57) ABSTRACT

A golf cleaning device for cleaning a golf club with a cleaning platform. The cleaning platform has a brush positioned on the underside of the cleaning platform to scrub the face of a golf club. Attached to the cleaning platform are arms that utilize a biasing mechanism and hold the platform in a generally V-shape. A user can step on the topside of the cleaning platform to change the angle of the V-shape to clean the golf club and the biasing mechanism returns the cleaning platform to its original angle.

11 Claims, 3 Drawing Sheets

GOLF CLUB CLEANING AID

PRIORITY/CROSS-REFERENCE TO RELATED APPLICATIONS

This application claims the benefit of U.S. Provisional Application No. 62/684,048, filed Jun. 12, 2018, the disclosure of which is incorporated by reference.

TECHNICAL FIELD

The disclosure generally relates to a device for cleaning golf clubs and more specifically to a device that is hands free and provides for a means of cleaning golf clubs of different sizes.

BACKGROUND

Golf club manufacturers spend millions of dollars every year to produce technology for the game of golf. Golf club manufacturers design clubs for optimum performance focusing on clubs that hit golf balls perfectly to deliver the most distance possible from every club. These golf clubs, especially irons, have grooves designed to create spin to generate drag and lift force for the golf ball when hit. The golf ball requires spin once hit to maintain velocity and controlled flight. It is of the utmost importance for a golf clubs grooves to be cleaned for optimum performance. Clean grooves reduce the chances of stray shots. Cleaning one's golf clubs regularly can be the difference between hitting the ball well and hitting the ball poorly. Additionally, clean golf clubs can be the difference between lost balls and sticking an iron shot; it can be the difference between shanking the golf shot or driving the tee shot right down to the middle of the fairway. When a club is dirty, it can easily contribute to extra strokes per round, which can lead to worse performance in playing. This is the reason that a thorough cleaning job of one's golf clubs should be a regular event that a player should do before or after every round of golf.

How often a golfer cleans his or her clubs will directly result in how well he or she plays golf. It is often best to clean clubs upon arriving home from playing a round of golf and before storage. There have been several methods of cleaning golf clubs. The traditional method of cleaning golf clubs involves using water or a liquid based solution with a rag and wiping the clubs down using hands manually. What is needed is an improved mechanism for cleaning the head of a golf club.

SUMMARY OF INVENTION

The purpose of the Summary of Disclosure is to enable the public, and especially the scientists, engineers, and practitioners in the art who are not familiar with patent or legal terms or phraseology, to determine quickly from a cursory inspection, the nature and essence of the technical disclosure of the application. The Summary of the Invention is neither intended to define the invention of the application, which is measured by the claims, nor is it intended to be limiting as to the scope of the invention in any way.

What is disclosed is a golf club cleaning device that comprises a first arm and a second arm. The first arm and the second arm are connected at each arm's second end via a base and form generally a V-shape. A biasing mechanism is configured to bias the first arm first end apart from a first arm second end, wherein a biasing mechanism is configured to bias the second arm first end apart from the second arm second end.

The golf club cleaning device also has a cleaning platform connected to the first arm and second arms' first end and is in a generally planar shape. The cleaning platform is the width of the base and the length of the upper arms. The cleaning platform is used by a consumer by placing weight on the first side in order to apply pressure to a golf club which is held against the cleaning surface that is attached to the second side of the cleaning platform.

The golf club cleaning device has a cleaning platform that is coupled to the cleaning attachment seated on the second side of the cleaning platform. Installed on the cleaning attachment is the cleaning surface. The cleaning surface is comprised of wire bristles.

The biasing mechanism of the golf club cleaning device has a first torsion spring and a second torsion spring. The first torsion spring is set where said upper first arm and the lower first arm connect, and the second torsion spring is set where the upper second arm and the lower second arm connect.

The cleaning platform can be in a wide variety of shapes, including the depicted generally rectangular shape.

The golf club cleaning device is configured for the lower first arm and lower second arm to be placed on a surface, more specifically, the ground.

Still other features and advantages of the claimed invention will become readily apparent to those skilled in this art from the preceding detailed description of preferred embodiments of the invention, simply by way of illustration of the best mode contemplated by carrying out my invention. As will be realized, the invention is capable of modification in various obvious respects all without departing from the invention. Accordingly, the description of the preferred embodiments is to be regarded as illustrative in nature, and not as restrictive in nature.

DETAILED DESCRIPTION OF THE PREFERRED EMBODIMENTS

Figure 1:
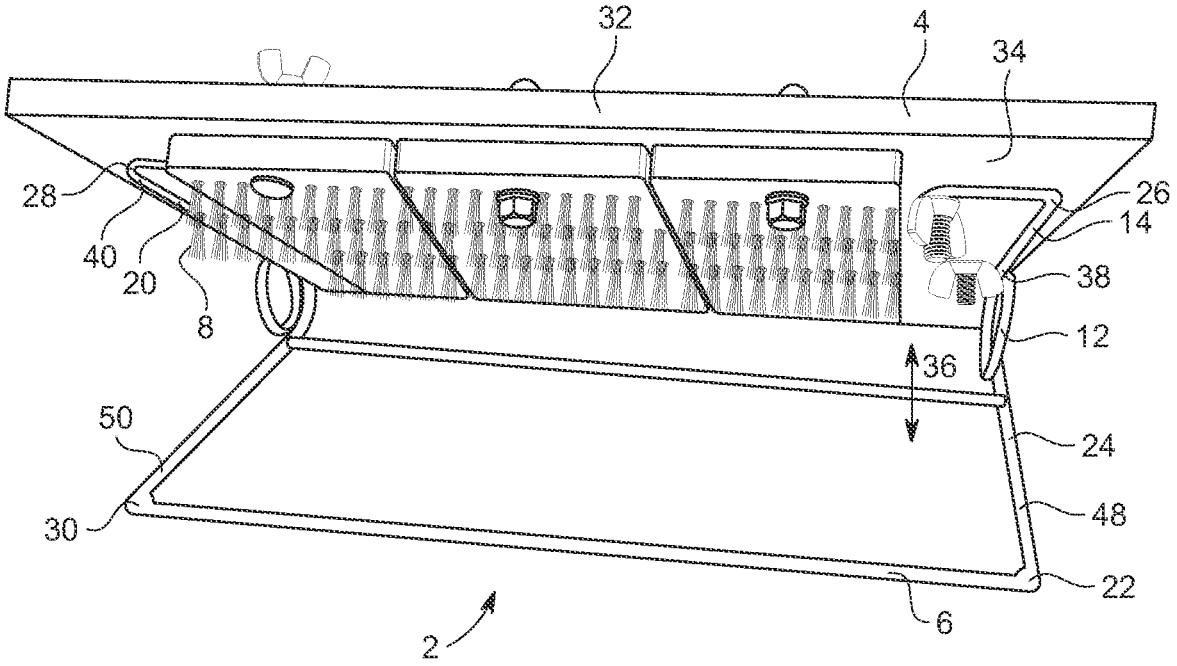
FIG. 1 is a front perspective view of the golf club cleaning aid.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Figure 2:
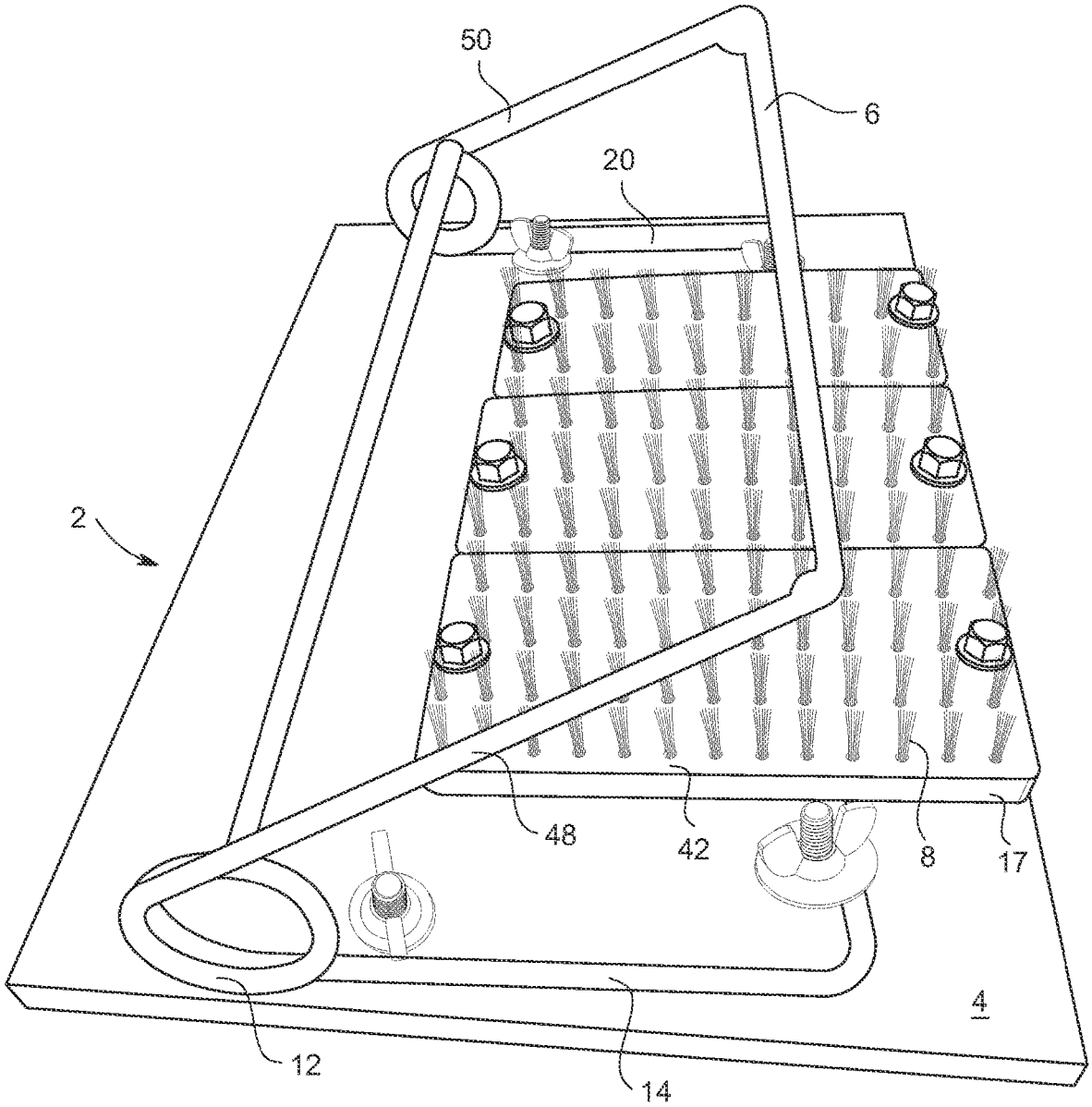
FIG. 2 is a right side perspective view of the bottom side of the cleaning surface of the golf club cleaning aid.
Figure 3:
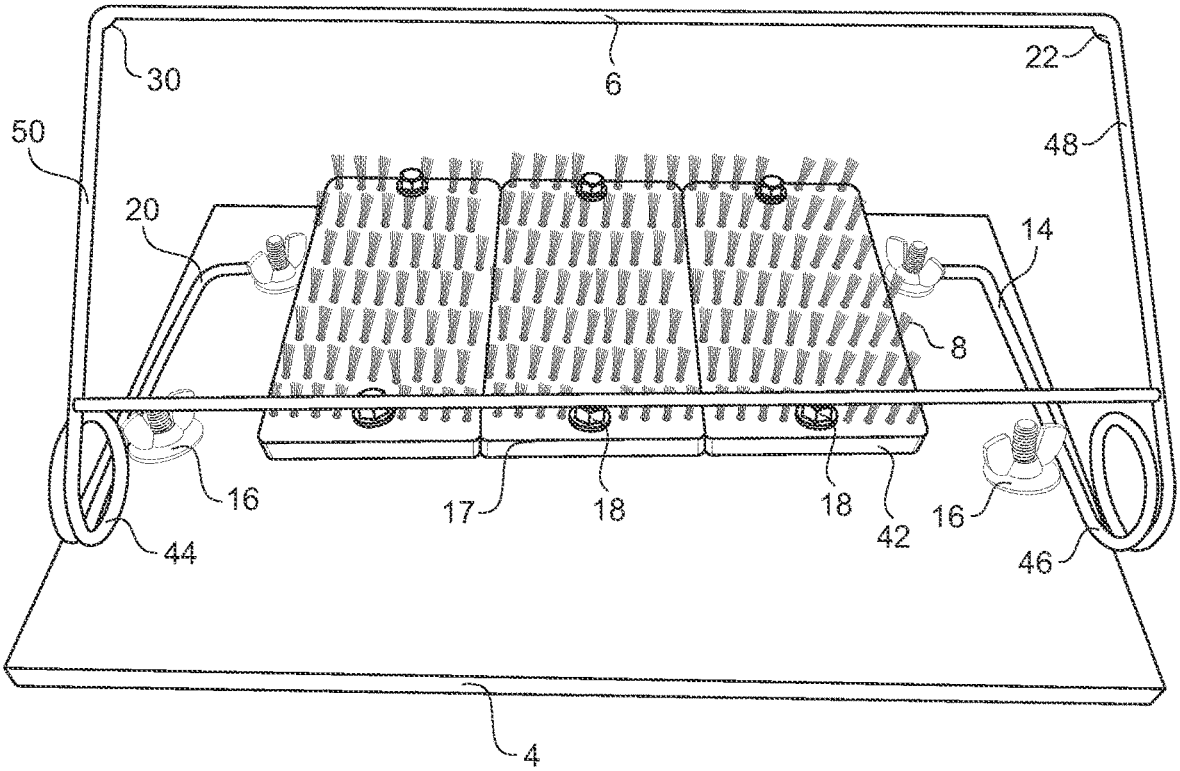
FIG. 3 is a rear perspective view of the bottom side of the cleaning surface of the golf club cleaning aid.

Certain preferred embodiments of the disclosed technology are shown in FIGS. 1 through 3.

FIG. 1 is a front perspective view of the golf club cleaning aid. In the preferred embodiment, to clean a golf club, a user places the golf club cleaning aid 2 on a ground surface. A user places weight on cleaning platform 4 to change the angle of the cleaning platform relative to the ground. A biasing mechanism biases the cleaning platform away from the ground. In a preferred embodiment this provides for a V-shape, with a cleaning device such as a brush positioned on the underside of the cleaning platform. In a preferred embodiment the brush is a wire brush. The first side 32 of the cleaning platform 4 faces upward and is stepped on by the user while the second side 34 of the cleaning platform 4 faces downward.

In the preferred embodiment, the golf club cleaning device comprises two arms: a first arm 20 and a second arm 14. Each arm has different components. The first arm 20 comprises an upper first arm 40, and a lower first arm 50, first torsion spring 44, first arm first end 28, and first arm second end 30. The first upper arm 40 is attached to the cleaning platform 4 while the first lower arm is placed on the ground. The first arm 20 comprises of a V-shape 36 which is manipulated when pressure is applied to the cleaning platform 4 due to the increased tension in the biasing mechanism 12. The biasing mechanism 12 in the first arm 20 comprises the first torsion spring 44. The cleaning platform 4 is connected to the first arm 20 via cleaning platform couplers 16.

In the preferred embodiment, the second arm 14 comprises an upper second arm 38, a lower second arm 48, a second torsion spring 46, a second arm first end 26, and a second arm second end 22. The second upper arm 38 is attached to the cleaning platform 4 while the lower second arm 48 is placed on the ground. The second arm 14 comprises a V-shape 36 which is manipulated when pressure is applied to the cleaning platform 4 due to the increased tension in the biasing mechanism 12. The biasing mechanism 12 in the second arm 14 comprises the second torsion spring 46. The cleaning platform 4 is connected to the second arm 14 via cleaning platform couplers 16.

In the preferred embodiment, the cleaning platform 4 has a cleaning platform first side 32 and a cleaning platform second side 34. The cleaning platform first side 32 is used by the consumer to apply pressure to the golf club cleaning aid 2. When pressure is applied to the cleaning platform first side 32, the force compresses the first torsion spring 44 and the second torsion spring 46. The torsion springs combine to make the biasing mechanism 12 which changes the angle of the V-shape 36 according to the amount of force and the type of golf club submitted for cleaning.

In the preferred embodiment, the cleaning platform second side 34 of the cleaning platform 4 comprises the cleaning attachment 17. The cleaning attachment 17 is coupled to the cleaning platform second side 34 using cleaning attachment couplers 18. In the preferred embodiment, the cleaning attachment 17 comprises a cleaning surface 8, which in the preferred embodiment are wire brushes that are used to scrub the face of a golf club. This scrubbing is used to clean the golf club from dirt, grass, and other contaminants.

In the preferred embodiment, the first arm second end 30 and the second arm second end 22 are connected to the base 6 which is placed on the ground or desired surface. In the preferred embodiment, a middle connection 24 further stabilizes the first arm second end 30 and the second arm second end 22.

FIG. 2 is a right side view of the bottom side of the golf club cleaning aid 2 displaying the cleaning surface 8. In the preferred embodiment, as shown is the cleaning attachment 17 attached to the cleaning platform 4. The cleaning attachment 17 comprises a cleaning surface 8 and in the preferred embodiment comprises of wire brushes. Shown is the base 6 which connects the first arm 20 to the second arm 14 by joining the lower second arm 48 and the lower first arm 50. Shown is the biasing mechanism 2. When no pressure is applied to the cleaning platform 4, the biasing mechanism will bias the upper arms from the lower arms in a V-shape 36.

FIG. 3 is rear view of the bottom side of the cleaning surface. In the preferred embodiment, shown is the lower second arm 50 joined to the lower first arm 48 by connecting the first arm second end 30 and the second arm second end 22 via the base 6. Shown are the first torsion spring 44 and the second torsion spring. The first arm 20 and the second arm 14 are connected to the cleaning platform 4 using cleaning platform couplers 16. The cleaning attachment 17 coupled to the cleaning platform 4 using the cleaning attachment coupler 18. Attached to the cleaning attachment 8 is the cleaning surface 8 in the form of wire brushes.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

I claim:

1. A golf club cleaning device, wherein said device comprises:

a base separating a first arm and a second arm, wherein said first arm comprises an upper first arm and a lower first arm, wherein said upper first arm and said lower first arm are connected to form a V-Shape, wherein said second arm comprises an upper second arm and a lower second arm, wherein said upper second arm and said lower second arm are connected to form a V-shape;

said upper first arm ending at a first arm first end, said lower first arm ending at a first arm second end, said upper second arm ending at a second arm first end, said lower second arm ending at a second arm second end;

a biasing mechanism, wherein said biasing mechanism is configured to bias said first arm first end apart from said first arm second end, wherein biasing mechanism is configured to bias said second arm first end apart from a second arm second end;

wherein said golf club cleaning device comprises a cleaning platform connected to said upper first arm and said upper second arm and is in generally planar shape, wherein said cleaning platform is the width of said base and the length of a upper first arm of said first arm and a upper second arm of said second arm, said base to be positioned on the ground such that wherein said cleaning platform is configured for a user to step on a cleaning platform first side in order to bias said cleaning platform toward said base to change the angle of said V-shape.

2. The golf club cleaning device of claim 1, wherein said cleaning device comprises said cleaning platform with a cleaning platform second side, wherein a cleaning attachment is coupled to said cleaning platform second side, wherein a cleaning surface is affixed to a cleaning attachment primary side of said cleaning attachment.

3. The golf club cleaning device of claim 2, wherein said cleaning surface comprises wire bristles.

4. The golf club cleaning device of claim 3, wherein said biasing mechanism comprises a first torsion spring and a second torsion spring, wherein said first torsion spring is set where said upper first arm of said first arm and a lower first arm of said first arm connect, wherein said second torsion spring is set where said upper second arm of said second arm and a lower second arm of said second arm connect.

5. The golf club cleaning device of claim 4, wherein said cleaning platform comprises a generally rectangular shape.

6. The golf club cleaning device of claim 5, wherein said lower first arm of said first arm and lower second arm of said second arm are configured for placement on a surface, wherein said golf club cleaning device is configured for placement on the ground.

7. A golf club cleaning device, wherein said device comprises:

first and second arms, wherein said arms are connected at a first end and form generally a V shape, wherein an arm comprises a generally planar shape;

a biasing mechanism, wherein said biasing mechanism is configured to bias the second ends of said arms apart, wherein said golf club cleaning device comprises a cleaning surface on a face of said first arm and located within said V-shape of said first and second arms of said golf club cleaning device, wherein said first arm is configured for a user to step on said first arm on a side opposite of said cleaning surface of said first arm in order to bias said first arm toward said second arm to change the angle between said first arm and said second arm.

8. The golf club cleaning device of claim 7, wherein said cleaning device comprises wire brush bristles.

9. The golf club cleaning device of claim 8, wherein said first arm comprises a generally rectangular shape, wherein said bristles are attached to a second side of said cleaning device.

10. The golf club cleaning device of claim 7, wherein said biasing device comprises a torsion spring, wherein said arms comprise arms of said torsion spring.

11. The golf club cleaning device of claim 7, wherein said second arm is configured for placement on a surface.

* * * * *